United States Patent [19]

Kakuda et al.

[11] Patent Number: 4,756,675

[45] Date of Patent: Jul. 12, 1988

[54] SCROLL TYPE FLUID TRANSFERRING MACHINE WITH SEPARATE MOTOR DRIVING EACH SCROLL

[75] Inventors: Masayuki Kakuda; Etsuo Morishita, both of Amagasaki, Japan

[73] Assignee: Mitsubishi Denki Kabushiki Kaisha, Tokyo, Japan

[21] Appl. No.: 51,774

[22] Filed: May 20, 1987

[30] Foreign Application Priority Data

Jun. 27, 1986 [JP] Japan ..... 61-151969

[51] Int. Cl.[4] ..... F01C 1/04; F04B 17/00; F04B 35/04

[52] U.S. Cl. ..... 418/55; 417/338; 417/410; 418/188

[58] Field of Search ..... 418/55, 57, 188; 417/338, 410

[56] References Cited

U.S. PATENT DOCUMENTS

| | | | |
|---|---|---|---|
| 3,884,599 | 5/1975 | Young et al. | 418/55 |
| 4,420,291 | 12/1983 | Winstead | 417/338 |

FOREIGN PATENT DOCUMENTS

| | | | |
|---|---|---|---|
| 55-96390 | 7/1980 | Japan | 418/55 |
| 2123089 | 1/1984 | United Kingdom | 417/338 |
| 737651 | 6/1980 | U.S.S.R. | 417/410 |

*Primary Examiner*—John J. Vrablik

*Attorney, Agent, or Firm*—Oblon, Fisher, Spivak, McClelland & Maier

[57] ABSTRACT

A scroll type fluid transferring machine for sucking, compressing and discharging a fluid comprises a first scroll having a first wrap plate, a second scroll having a second wrap plate which is opposed to and combined with the first scroll, a first motor having a rotary shaft which is connected to the first scroll so as to be in agreement with its center of rotation, and a second motor having a rotary shaft which is connected to the second scroll so as to be in agreement with its center of rotation.

4 Claims, 4 Drawing Sheets

SCROLL TYPE FLUID TRANSFERRING MACHINE WITH SEPARATE MOTOR DRIVING EACH SCROLL

BACKGROUND OF THE INVENTION

1. Field of the Invention

The present invention relates to a scroll type fluid transferring machine for sucking, compressing and discharging a fluid. More particularly, it relates to a total system rotation type scroll machine in which two scrolls are mutually combined and respectively rotated.

2. Discussion of Background

The principle of a scroll type fluid transferring machine, especially a scroll compressor has been known. The scroll compressor is a kind of a positive displacement type compressor in which a pair of scrolls are combined with each other to effect compression of a fluid.

In the ordinary scroll compressor, one of the scrolls is made stationary and the other is subject to an orbital movement with respect to the stationary scroll to effect the compression.

The principle of a total system rotation type scroll compressor in which both scrolls are respectively rotated around their own axial center, is also well known (in a publication such as Japanese Unexamined Patent Publication No. 46081/1980).

FIGS. 5*a*, 5*b*, 5*c* and 5*d* show the principle of the total system rotation type scroll compressor. A first scroll 1 is caused to rotate around its own axial center $O_1$ by a driving source such as a motor, an engine, a turbine and so on. A second scroll 2 is also caused to rotate around its axial center $O_2$ in synchronism with the rotation of the first scroll 1. A compression chamber 3, which is formed by combining the first and second scrolls 1, 2, moves toward the rotation centers as the both scrolls rotate while the volume of the chamber 3 is gradually reduced. The pressure of a gas confined in the compression chamber 3 increases and a highly pressurized gas is discharged through a discharge port 4.

FIG. 5*a* shows a state of the combined scrolls 1, 2 at its moving phase of 0°, in which the gas is sucked in the compression chamber 3. As the scrolls rotate as shown in FIGS. 5*b* to 5*d*, they assume the moving phases of 90°, 180°, 270° and 360° C. (0°) succesively, whereby the compression chamber 3 gradually shifts toward their revolution centers with the result of reduction in the volume of the gas. The two scrolls 1, 2 provide sealing portions S by mutual contact of the side surfaces of the wrap plates 1*a*, 2*a* of the scrolls 1, 2. The sealing portions S are in alignment with each other in the radial direction of the first and second scrolls 1, 2; namely, they always take a constant positional relation in a static state of the scrolls.

However, in the conventional total system rotation type scroll compressor in which the second scroll is caused to rotate by the rotation of the first scroll through the mutual contact of the wrap plates without using an Oldham coupling, there are problems of generation of noises and friction caused by the mutual contact of the wrap plates because the second wrap plate 2*a* of the second scroll 2 is directly in contact with and driven by the first wrap plate 1*a* of the first scroll 1.

SUMMARY OF THE INVENTION

It is an object of the present invention is to provide a scroll type fluid transferring machine providing a smooth rotation while eliminating vibrations and noises without employing a torque transmission through the friction between the wrap plates of the first and second scrolls.

It is another object of the present invention to provide a scroll type fluid transferring machine which reduces a load to each bearing part and is suitable for operations under a high speed revolution.

The foregoing and the other objects of the present invention have been attained by providing a scroll type fluid transferring machine for sucking, compressing and discharging a fluid which comprises a first scroll having a first wrap plate, a second scroll having a second wrap plate which is opposed to and combined with the first scroll, a first motor having a rotary shaft which is connected to the first scroll so as to be in agreement with their centers of rotation, and a second motor having a rotary shaft which is connected to the scroll so as to be in agreement with their centers of rotation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Preferred embodiments of the present invention will be described with reference to FIGS. 1 and 2.

Figure 1:
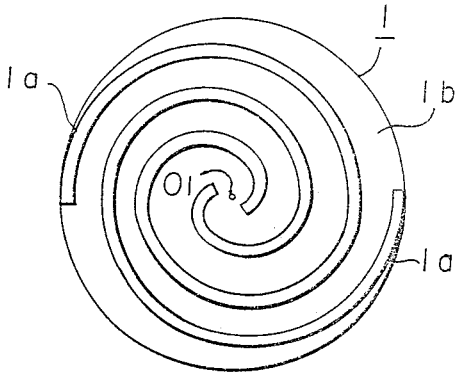
FIG. 1 is a plane view of an embodiment of a first scroll used for the scroll type fluid transferring machine of the present invention.
Figure 2:
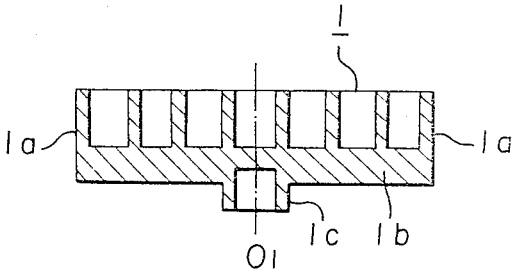
FIG. 2 is a longitudinal cross-sectional view of the first scroll shown in FIG. 1.

In FIGS. 1 and 2, a first scroll 1 comprises a circular plate 1*b*, a boss 1*c* projecting from one surface of the circular plate 1*a* and two first wrap plates 1*a* formed on the other surface of the circular plate 1*b*. The two wrap plates 1*a* have the same configuration and are arranged in such a manner that they are symmetric with respect to the axial center $O_1$ of revolution and have the same pitch in the circumferential direction so as to obtain a balanced centrifugal force when it is rotated. The boss 1*c* is provided with a recess in which a shaft is fitted.

Figure 3:
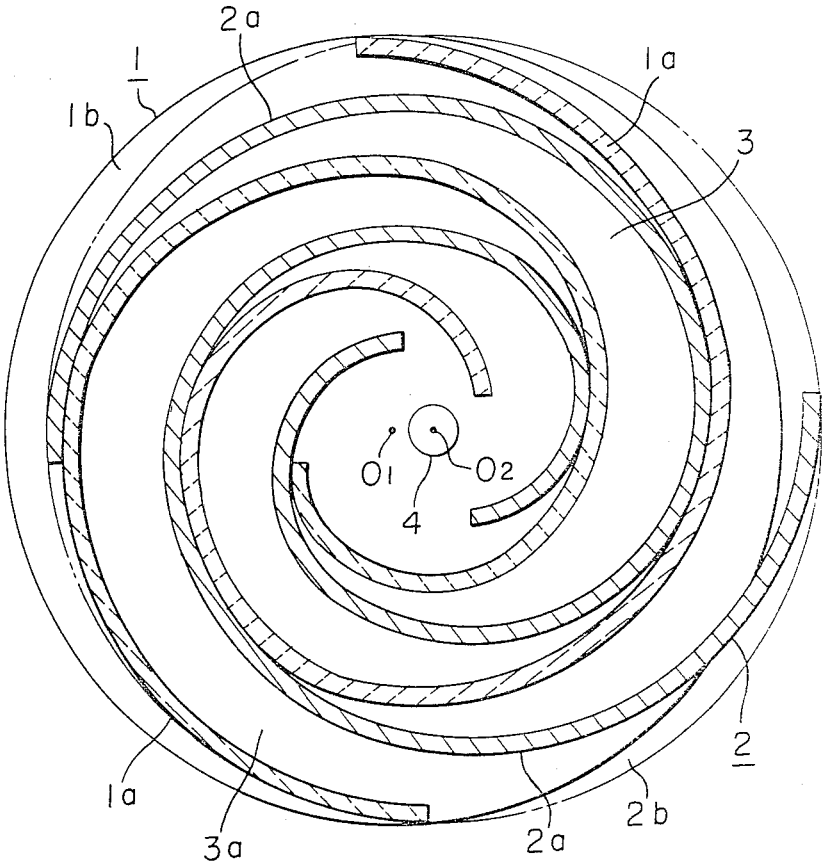
FIG. 3 is a diagram showing the movement of the scroll compressor according to an embodiment of the present invention.

FIG. 3 is a diagram showing that a second scroll 2 is combined with the first scroll as in FIG. 1. For simplification, the number of turns of the wrap plates is reduced. The second scroll 2 also comprises a circular plate 2*b* and two second wrap plates 2*a* which have the same shape as that of the first scroll and are arranged at positions symmetric with respect to the axial centor $O_2$ of revolution and at the same pitch in the circumferential direction so as obtain a balanced centrifugal force.

FIG. 3 shows a state when a suction step by the compression chamber 3 has finished. A reference numeral 3*a* designates the compression chamber before effecting the compression. FIG. 3 shows that the suction step is conducted four times during one revolution, namely, the phase of suction is shifted for each one fourth (90°) of one revolution.

In case that two wrap plates are formed on the circular plate of each of the scrolls 1, 2, communication between the compression chamber 3*a* and the discharging port 4 must be avoided in the suction step even at any angle of revolution. Accordingly, in the embodiment shown in FIG. 3, the number of turns of the wrap plates is at least one and one fourth ($1\frac{1}{4}$). It is understandable that this value is geometrically smallest. When the number of turns is one and one fourth, the ratio of the volume of the chamber is 1. In this case, the function of compression is not theoretically provided and the device functions as a pump. Accordingly, when two wrap plates are provided in each of the scrolls, the number of turn is equal to or greater than $1\frac{1}{4}$ (i.e., $\geqq 1\frac{1}{4}$). Generally, an N ($N \geqq 2$) number of wrap plates are formed in each of the scrolls, the number of turn is equal to or greater than 1(1/2N) (i.e., $\geqq$ 1(1/2N).

When N number of wrap plates are respectively formed in the first and second scrolls 1, 2, there are 2N times of suction during one revolution and the phase of suction is shifted for each 360°/(2N). If a large number of wrap plates are formed on the scrolls ($N \rightarrow \infty$), the number of turns can be at least one.

Figure 5:
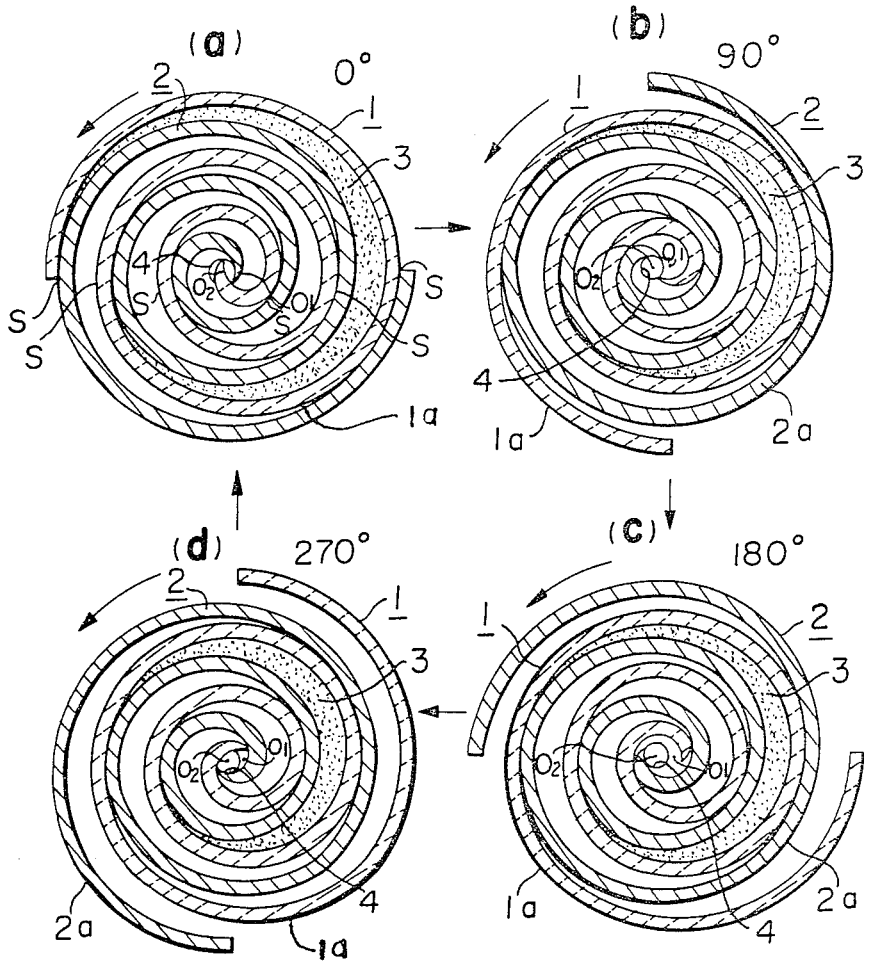
FIGS. 5(*a*)–5(*d*) are diagrams showing the principle of the operation of a typical total system rotation type scroll compressor.

The scroll compressor having each two wrap plates 1*a*, 2*a* on the respective scrolls as shown in FIG. 3 performs four times of suction during one revolution in comparison with the conventional scroll compressor shown in FIG. 5 which performs only one suction during one revolution. Accordingly, the scroll compressor of the this embodiment reduces pulsation of the compressed gas with the result that variation of a torque and vibration of the compressor are remakably decreased.

Figure 4:
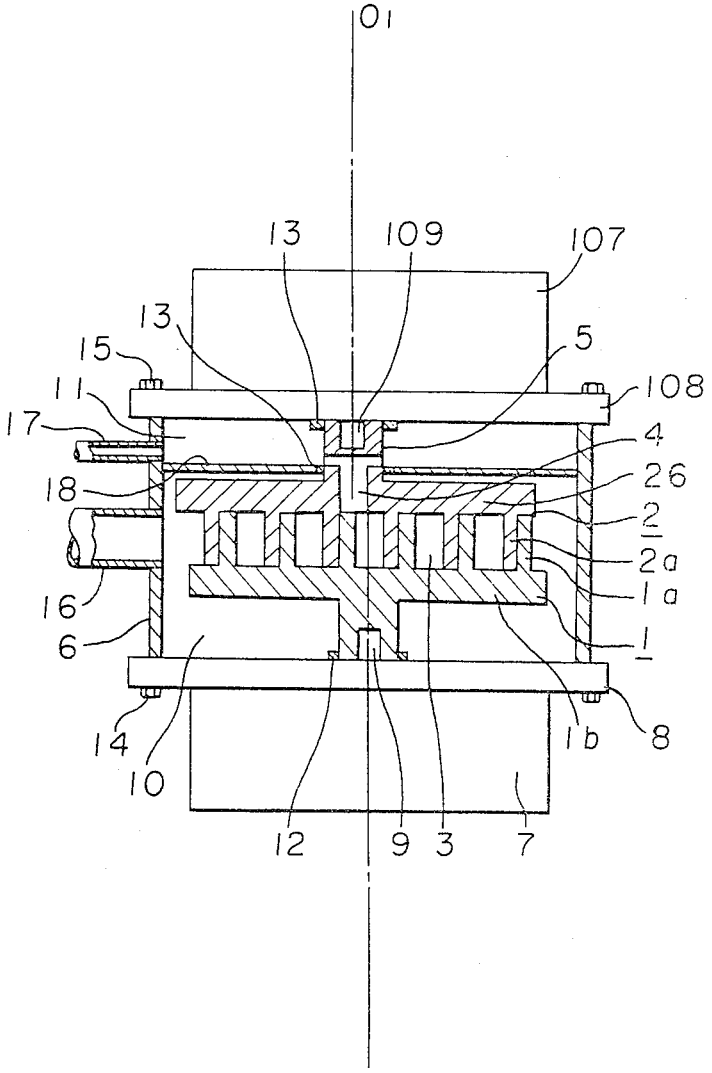
FIG. 4 is a longitudinal cross-sectional view of an embodiment of the scroll compressor of the present invention.

FIG. 4 is a longitudinal cross-sectional view of the scroll compressor shown in FIG. 3 in which the first and second scrolls are combined together. The first scroll 1 has the two wrap plates 1*a* on the circular plate 1*b*. The second scroll 2 has the circular plate 2*b* on which two wrap plates 2*a* are formed so as to be combined with the first wrap plates 1*a* of the first scroll 1. A shaft 5 is formed integrally with or firmly connected to the circular plate 2*b* on the side opposite to the second wrap plates 2*a*. A discharge port 4 is formed at the center of the circular plate 2*b* passing therethrough. A reference numeral 7 designates a first motor having a rotary shaft 9 which is connected to the shaft of the first scroll 1 and a numeral 107 designates a second motor having a rotary shaft 109 connected to the shaft 5 of the second scroll 2. The first and second scrolls 1, 2 are placed in a housing 6 in such a manner that the first and second wrap plates 1*a*, 2*a* are combined together and the center of rotation $O_1$ of the second scroll 2 is in agreement with the center of rotation of the rotary shaft 109 of the second motor 107, and the center of rotation $O_2$ of the first scroll 1 is in agreement with the center of rotation of the rotary shaft 9 of the first motor 7. A flange 8 of the first motor 7 and a flange 108 of the second motor 107 are respectively connected to the housing 6 by means of respective bolts 104, 105. Numerals 12, 13 designate sealing members which prevent the fluid from leaking from the first and second scrolls 1, 2 during their rotation, a numeral 16 designates an air intake tube connected to the housing 6, a numeral 17 designates a discharge tube connected to the housing, and a numeral 18 designates a partition plate for separating a discharge chamber 11 from an air intake chamber 10.

The operation of the scroll type fluid transferring machine of the present invention will be described.

When the first and second motors 7, 107 are actuated, the rotary shafts 9, 109 are each respectively rotated around its own revolution center $O_1$ or $O_2$ in the same direction, whereby the first and second scrolls are caused to rotate. For the first and second motors 7, 107, ones having the same output power are used so that a torque applied to the first scroll 1 is equal to that of the second scroll 2. Thus, the first and second scrolls 1, 2 are rotated at the same revolution speed during which the first and second wrap plates 1*a*, 2*a* do not contact with each other.

The fluid sucked through the air intake tube 16 connected to the housing 6 into the air intake chamber 10 is compressed in the compression chamber 3, and then, is discharged into the discharge chamber 11 through the discharge port 4, and finally is introduced outside of the housing 6 through the discharge tube 17.

The partition plate 18 forms the air intake chamber 10 and the discharge chamber 11 in association with the housing 6 and the flanges 8, 108 of the motors 7, 107. The sealing members 12, 13 prevent the fluid from leaking from the rotating parts.

To improve sealing properties, the first scroll 1 may be pushed to the second scroll 2 in its axial direction and its radial direction by utilizing a fluid pressure or a spring action.

Although the N number ($N \geqq 2$) of wrap plates are used in the above-mentioned embodiment, a single wrap plate may be used.

Description has been made as to application of the present invention to a compressor. However, this invention is applicable to a fluid transferring machine of a type in which a fluid is sucked through the discharge port 4.

The inventors of this application note that a compressor having first and second scrolls each having a motor is disclosed in Japanese Unexamined Patent Publication No. 96390/1980. However, the compressor is of such a type that both the scrolls are subjected to an orbiting movement and the idea of this invention is different from that in the published application. Namely, the fluid transferring machine according to the present invention is to rotate each of the scrolls around its own revolution center with a simple construction.

Thus, in accordance with the present invention, it is unnecessary to employ the sliding movement to transmit a torque by the mutual contact of the wrap plates, and accordingly, problems of energy loss by the sliding contact, noises and friction caused by the sliding movement can be eliminated.

Obviously, numerous modifications and variations of the present invention are possible in light of the above teachings. It is therefore to be understood that within the scope of the appeneded claims, the invention may be practiced otherwise than as specifically described herein.

What is claimed is:

1. A scroll type fluid transferring machine for sucking, compressing and discharging a fluid, which comprises:

a first scroll having a first wrap plate, a second scroll having a second wrap plate which is opposed to and combined with said first scroll, a first motor having a rotary shaft which is connected to said first scroll, wherein a center of rotation of said first motor rotary shaft is in agreement with a center of rotation of said first scroll, and a second motor having a rotary shaft which is connected to said second scroll, wherein a center of rotation of said second motor rotary shaft is in agreement with a center of rotation of said second scroll, wherein said first and second scrolls are mutually combined without any coupling means for synchronizing their movement.

2. The scroll type fluid transferring machine according to claim 1, wherein said first and second wrap plates are so combined that they keep symmetric position at any point of rotation.

3. The scroll type fluid transferring machine according to claim 1, wherein each of said first and second scrolls has a plurality of wrap plates which are the same shape and are arranged at the same pitch in the circumferential direction.

4. The scroll type fluid transferring machine according to claim 1, wherein the output powers of said first and second motors are the same.

* * * * *